US005363622A

United States Patent [19]

Sauer

[11] Patent Number: 5,363,622

[45] Date of Patent: Nov. 15, 1994

[54] FIRE-RATED DRYWALL SUSPENSION SYSTEM

[75] Inventor: Gale E. Sauer, Sinclairville, N.Y.

[73] Assignee: Armstrong World Industries, Inc., Lancaster, Pa.

[21] Appl. No.: 996,626

[22] Filed: Dec. 24, 1992

[51] Int. Cl.[5] ..... E04B 9/00

[52] U.S. Cl. ..... 52/506.07; 52/667; 52/DIG. 5; 403/363

[58] Field of Search ..... 52/484, 488, 667, DIG. 5, 52/726.1, 726.2, 732, 483, 573; 403/363

[56] References Cited

U.S. PATENT DOCUMENTS

| | | | |
|---|---|---|---|
| 3,367,695 | 2/1968 | Haertel et al. | 52/667 |
| 4,208,851 | 6/1980 | Sauer | 52/573 |
| 4,866,900 | 9/1989 | Dunn | 52/488 |

*Primary Examiner*—Carl D. Friedman
*Assistant Examiner*—Kevin D. Wilkens

[57] ABSTRACT

A suspended grid system to support screw applied drywall ceilings. The system includes parallel rows of main runners suspended from the structural ceiling. Cross channel members are attached in parallel rows at right angles to the main runners. Drywall is screw attached to the lower surface of the cross channel members. Connectors are formed on the ends of the cross channel members which engage and lock to the main runners. Each such connector uses two upper latches and two lower tongue shaped stop shoulders. The lower stop shoulders will collapse in a controlled manner to relieve excessive compression as would be created from thermal expansion. The main runner will also provide a means for relieving thermal expansion.

1 Claim, 2 Drawing Sheets

FIRE-RATED DRYWALL SUSPENSION SYSTEM

BACKGROUND OF THE INVENTION

Field of the Invention

This invention is directed to a fire resistant ceiling grid support system intended for screw application of drywall.

Description of the Prior Art

The system, as with earlier systems per U.S. Pat. Nos. 4,208,851 and 4,866,900, uses main runners and cross channel members. Main runners are suspended in parallel rows from the building's structural ceiling. Cross channel members are affixed at right angles to the main runners and occur in parallel rows throughout the ceiling.

The main runners have a profile similar to that of an inverted "T" and have a means for relieving thermal expansion. Cross channel members are shaped with a central surface oriented to meet the top surface of the wallboard and receive self-tapping and self-drilling screws.

The system of this invention, along with the earlier referenced systems, use locking connectors formed on the end of the cross channel members. These connectors intersect with and lock to the main runners. The connector ends also include a means to relieve thermal expansion. An improved connector and means for providing thermal expansion relief is the subject of this disclosure.

The earlier connectors used both latch and expansion relief stops, configurated on the top flanges of the cross channel member ends. Such a connection will be hinge-like and will not permit a rigid connector to the main runner.

This invention provides an improved connection. It contains a pair of latches on the top surface of the cross channel member that will engage one side of the main runner. Then a pair of tongue shaped stops occur on the lower channel flanges of the connector which will engage the opposite side of the main runner. With two opposing connector ends engaging a main runner, a more rigid intersection is achieved. The upper web of the main runner is contained between two pairs of latch shoulders, and the lower web of the main runner contained between two pairs of tongue-shaped stops. Such a coupling is capable of resisting negative moment, and this will enhance the load carrying ability of the cross channel member.

In addition, the lower tongue-shaped stop shoulders bearing on the main runner are designed to collapse under excessive compression as would be created through thermal expansion.

An improved locking connector with the ability to relieve thermal expansion is offered in this disclosure.

SUMMARY OF THE INVENTION

The present invention is directed to providing a fire-rated suspended ceiling for drywall in which the cross channel members have firm connection with the main runners which will compress in a controlled manner when subjected to thermal expansion to prevent uncontrolled buckling. In addition, main runners are provided with a means to relieve thermal expansion.

To accomplish these goals, the present invention includes a system having cross channel members and main runners. The cross channel members provide a surface for the screw attachment of drywall. Cross channels have connectors on each end for attachment to main runners. The main runners have spaced apertures in their webs to interlock the cross channel connectors.

The cross channels are of a shape with a flat base connected to two side walls that extend substantially upward and terminate in outwardly extending flanges. To enable connection to the main runner, the cross channel connector ends are tapered in a manner to be inserted through the apertures of the main runner. Following this tapered lead on the upper flanges are shoulders which will prevent withdrawal from the main runner apertures. Two tongue shaped stops are formed in the lower side wall areas which will abut the side web of the main runner when the connector is fully inserted. These tongue stops are so designed that they will buckle when subjected to high compression forces initiated by thermal expansion.

When two opposing cross channel end connectors are engaged through the same main runner apertures, a very rigid intersection is achieved. The main runner's upper web is fixed between two pairs of latches and the lower web is fixed between two lower tongue stops. The intersection rigidly holds the main runner from rotation and will resist negative moment adding to the load carrying capability of the cross channel members.

DESCRIPTION OF THE PREFERRED EMBODIMENTS

Figure 1:
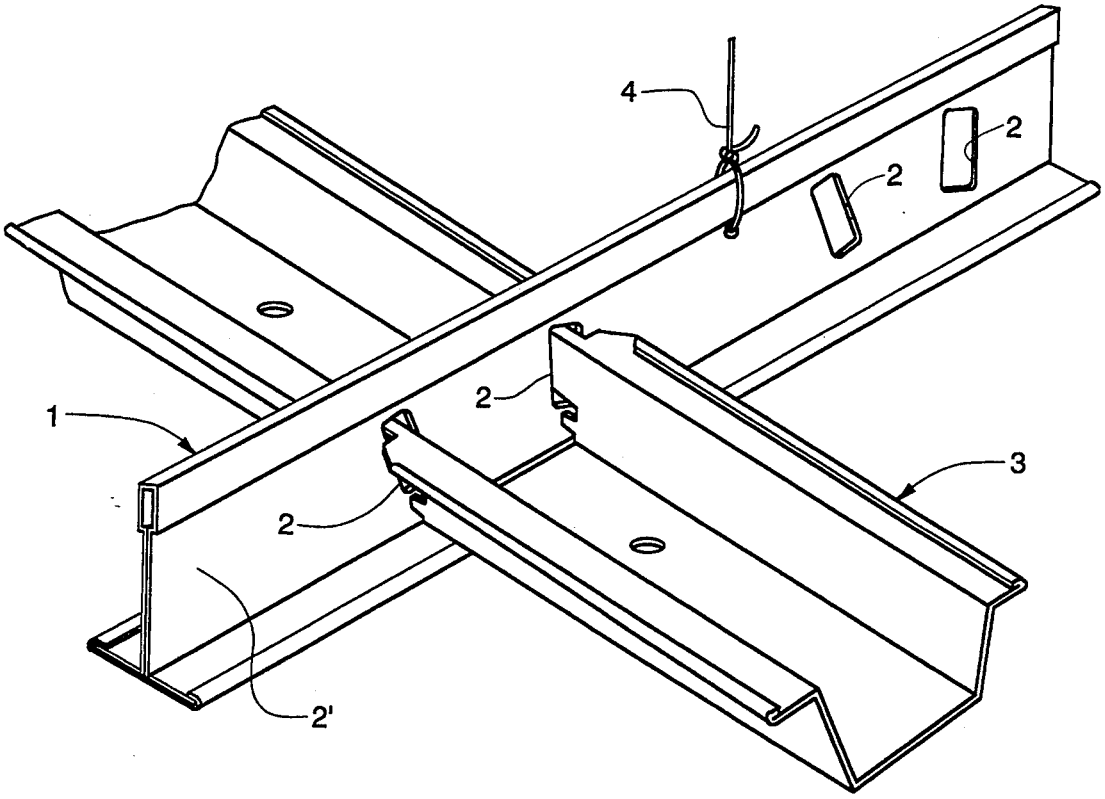
FIG. 1 is a fragmentary perspective view of a main runner, cross channel intersection.
Figure 2:
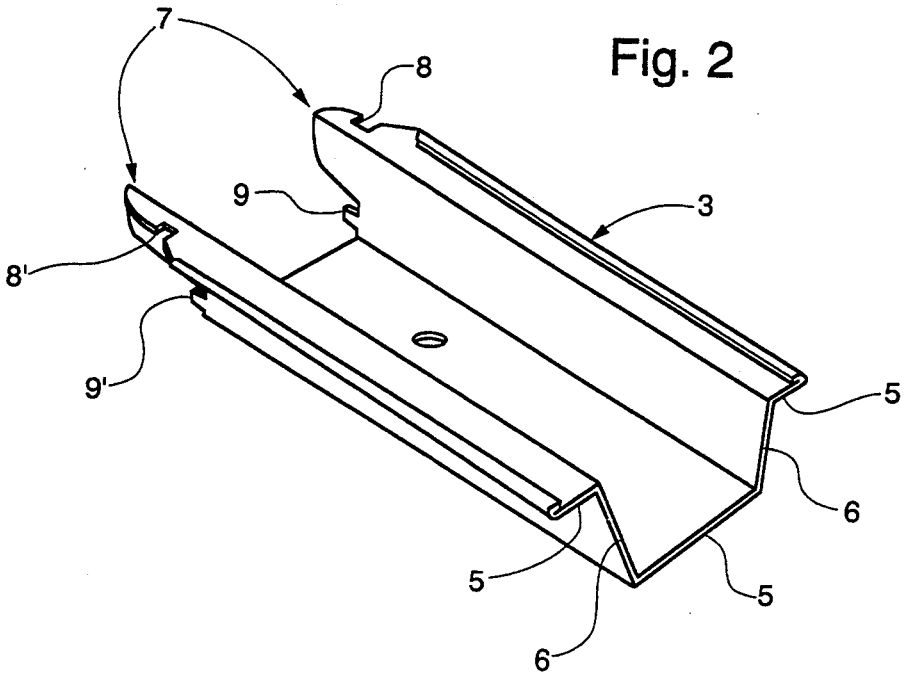
FIG. 2 is a perspective showing the connector detail at the end of a cross channel member.

Referring to FIGS. 1, 2, 3 and 4, there is shown the locking intersection of a grid ceiling system designed to carry screw applied wallboard.

The grid system is composed of main runners 1 which are supported by hanger wires 4 from the building's structural ceiling. Main runners are the shape of an inverted "T" and occur in parallel rows throughout the ceiling. Each main runner will have periodic pairs of spaced apertures 2 along the web 2' to receive intersecting and locking cross channel members 3. Main runners also have conventional means at each end for splicing successive main runners together in a long continuous row. In addition, main runners have conventional means for relieving thermal expansion.

Cross channel members 3 (FIG. 2) are of a shape with a flat base and a pair of upstanding side walls. The flanges are resiliently biased outward to the position illustrated in the figures and can be squeezed to be moved inwardly. At the ends of the cross channel members are connectors 7 designed to intersect and lock within the main beam apertures 2. The cross channel members are installed between main runners in parallel rows across the ceiling to complete the grid support system. Wallboard is then lifted to the support system and screw attached to the flat base 5 of the cross channel members.

The subject of this invention is the cross channel/-main runner lock and the means for relieving thermal expansion in the cross channels.

To form the connection between cross channel members 3 and the main runner 1, the main runner is provided with a pair of apertures 2. The shape of the apertures and the lead end of the cross channel member connector end 7 are dimensionally coordinated for insertion. As the connector end 7 is inserted through the pair of apertures 2, the resilient side walls are cammed inward. When the insertion passes the pair of latch shoulders 8 and 8', the resilient side walls recover and the latch shoulders 8 and 8' will bear on the opposite side of the main runner web adjacent the apertures 2 and prevent withdrawal. In addition, further insertion will be prevented by a pair of tongue shaped stop shoulders 9 and 9' which are cut in the lower side walls and press against the web 2'. An opposing cross channel member is to be inserted through the same pair of apertures to complete the grid intersection as shown in FIG. 1.

Figure 3:
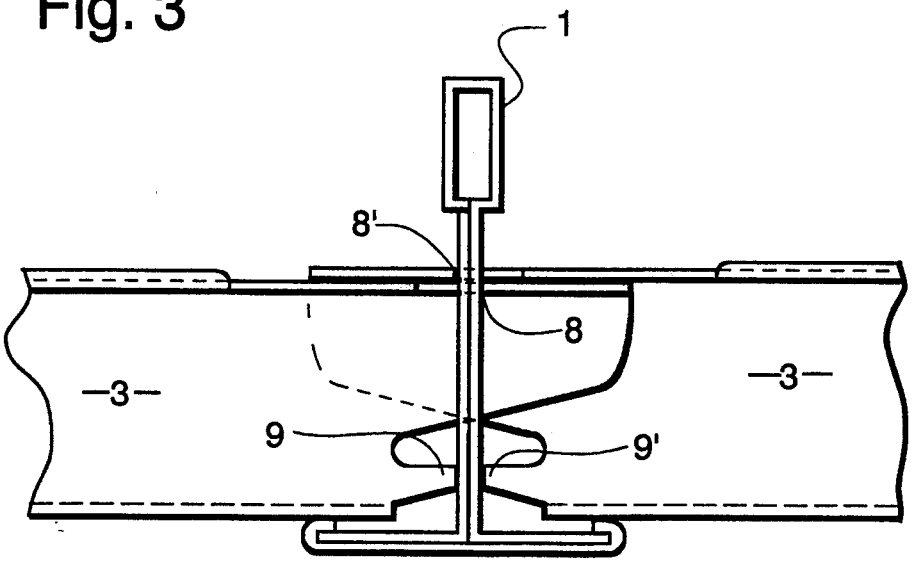
FIG. 3 is a side view of a cross channel member and main runner intersection.

When opposing cross channel members are locked through the same pair of main beam apertures as shown in FIG. 3, the upper web portion of the main runner is contained between two pairs of opposing latches 8 and 8'. The lower web portion of the main runner is contained between two pairs of opposing stop shoulders 9 and 9'.

Such a connection will prevent the main runner from rotation. Further, as the cross channel members perform their function as beams in carrying wallboard, the high/low coupling of latch and stops will resist negative bending moment and add carrying strength.

During a fire the thermal expansion of the main runner and cross channel members will distort and buckle unless a controlled means for relieving thermal expansion is provided.

Figure 4:
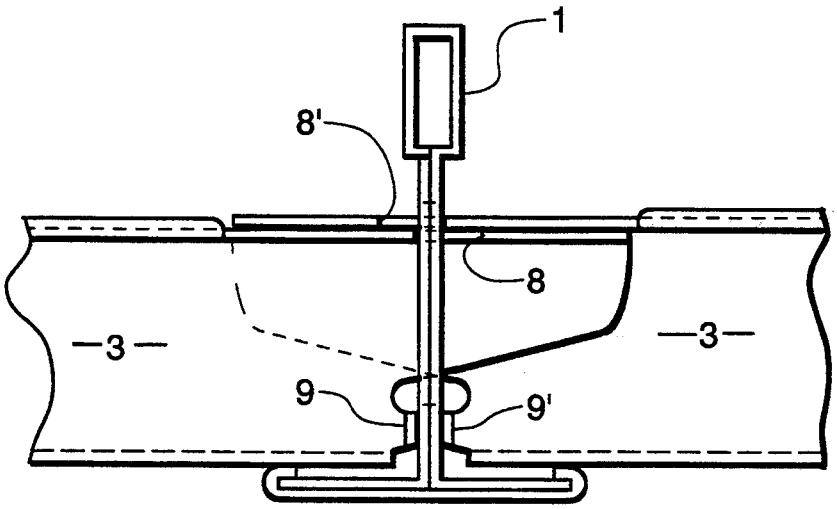
FIG. 4 is a side view of a cross channel member and main runner intersection after it has compressed to relieve thermal expansion.

The tongue shaped stops 9 and 9' provide an expansion relief mechanism for the cross channel members. When an excessive compression force is exerted the tongue shaped stops will buckle permitting the connection ends to move further through the main beam aperture. FIG. 4 illustrates a pair of opposing cross channels which have relieved expansion as described above.

What is claimed is:

1. A suspension system for supporting ceiling drywall comprising:

(a) at least three main runners;

(b) a number of cross runners positioned between the main runners and connected thereto;

(c) said main runner having a web with a pair of cross runners on either side thereof and the pair of cross runners being connected to the opposite sides of the main runner at the same point;

(d) the cross runners are shaped with an elongated flat base, a pair of upstanding side walls extending from the sides of the base and flanges, parallel to the base, extending from the top of the side walls;

(e) the flanges having connector ends on each end thereof, the connector ends have notches cut therein to form a latch shoulder near the end of the connector end;

(f) the side walls near the base having tongue shaped stops extending from the side walls under the notch;

(g) the main runner having two apertures in its web with the connector ends of each cross runner inserted into the apertures and the latch shoulder and end of the tongue shaped stops positioned so that the latch shoulders engage the side of the main runner web near the apertures opposite from the side where the cross runner is located and the end of the tongue shaped stop engages the side of the main runner web below the apertures on the side of the web where the cross runner is located;

(h) the pair of cross runners on either side of the main runner being inserted from opposite sides into the pair of apertures so that the latch shoulders of each cross runner engage opposite sides of the main runner web at the same point and the ends of the tongue shaped stops of each cross runner engage opposite sides of the main runner web at the same point; and (i) the tongue shaped stops are formed to buckle when excessive force is applied thereto to provide a means to relieve thermal expansion of the cross runner.

* * * * *